US011286692B2

(12) United States Patent
Lien

(10) Patent No.: US 11,286,692 B2
(45) Date of Patent: Mar. 29, 2022

(54) DOOR LOCK

(71) Applicant: WFE TECHNOLOGY CORP., Taichung (TW)

(72) Inventor: Chih-Min Lien, Taichung (TW)

(73) Assignee: WFE TECHNOLOGY CORP., Taichung (TW)

( * ) Notice: Subject to any disclaimer, the term of this patent is extended or adjusted under 35 U.S.C. 154(b) by 330 days.

(21) Appl. No.: 16/731,362

(22) Filed: Dec. 31, 2019

(65) Prior Publication Data

US 2021/0062544 A1 Mar. 4, 2021

(30) Foreign Application Priority Data

Sep. 3, 2019 (TW) ..... 108131703

(51) Int. Cl.

| | |
|---|---|
| ***E05B 63/08*** | (2006.01) |
| ***E05B 63/20*** | (2006.01) |
| ***E05B 59/00*** | (2006.01) |
| ***E05B 47/00*** | (2006.01) |
| ***E05B 9/02*** | (2006.01) |
| ***E05B 15/04*** | (2006.01) |

(52) U.S. Cl.

CPC ..... *E05B 63/08* (2013.01); *E05B 9/02* (2013.01); *E05B 15/04* (2013.01); *E05B 47/0001* (2013.01); *E05B 59/00* (2013.01); *E05B 63/20* (2013.01); *E05B 2047/0095* (2013.01); *E05Y 2900/132* (2013.01)

(58) Field of Classification Search

CPC ..... E05B 9/02; E05B 2009/004; E05B 15/04; E05B 47/0001; E05B 2047/0095; E05B 59/00; E05B 55/00; E05B 55/12; E05B 63/08; E05B 63/14; E05B 63/143; E05B 63/20; E05Y 2900/132

See application file for complete search history.

(56) References Cited

U.S. PATENT DOCUMENTS

| | | | | |
|---|---|---|---|---|
| 6,578,888 | B1 * | 6/2003 | Fayngersh | E05B 63/20 292/169.14 |
| 7,007,985 | B2 * | 3/2006 | Alexander | E05B 63/20 292/163 |
| 7,303,215 | B2 * | 12/2007 | Moon | E05B 63/20 292/169 |
| 8,292,336 | B2 * | 10/2012 | Moon | E05B 63/16 292/61 |
| 9,803,395 | B2 * | 10/2017 | Chen | E05B 63/08 |
| 9,982,457 | B2 * | 5/2018 | Chen | E05B 17/22 |
| 10,907,381 | B2 * | 2/2021 | Lien | E05B 63/08 |
| 2008/0087055 | A1 * | 4/2008 | Chen | E05B 63/16 70/107 |
| 2017/0175420 | A1 * | 6/2017 | Chen | E05B 63/16 |
| 2018/0274264 | A1 * | 9/2018 | Raatikainen | E05B 15/04 |
| 2020/0157847 | A1 * | 5/2020 | Liu | E05B 63/20 |

* cited by examiner

*Primary Examiner* — Christopher J Boswell
(74) *Attorney, Agent, or Firm* — Burris Law, PLLC

(57) ABSTRACT

A door lock disposed on a door leaf includes a casing, a bolt member, a latch member, an auxiliary latch member and a transmission unit. When the door lock is in an open state, the bolt member is retracted into the casing and held by the transmission unit. During a closing operation of the door leaf, the latch member and the auxiliary latch member are successively pushed into the casing to actuate the transmission unit, so that the transmission unit releases the bolt member when the door leaf is closed, and that the bolt member automatically projects out of the casing to lock the door leaf.

10 Claims, 19 Drawing Sheets

DOOR LOCK

CROSS-REFERENCE TO RELATED APPLICATION

This application claims priority of Taiwanese Invention Patent Application No. 108131703, filed on Sep. 3, 2019.

FIELD

The disclosure relates to a door lock, and more particularly to an automatic door lock.

BACKGROUND

A conventional door lock is mounted to a door leaf. For locking the door leaf, the conventional door lock needs to be operated manually after the door leaf is closed. Such operation may be inconvenient.

SUMMARY

Therefore, an object of the disclosure is to provide a door lock that can alleviate the drawback of the prior art.

According to the disclosure, the door lock is adapted to be disposed on a door leaf. The door leaf is pivotally connected to a door frame. The door lock includes an outer casing, a bolt unit, a latch unit, an auxiliary latch unit and a transmission unit. The outer casing defines a retaining space therein, and includes a front plate, and a rear plate that is spaced apart from the front plate in a front-rear direction. The bolt unit is disposed in the outer casing, and includes a bolt member that is movable in the front-rear direction and that is operable to project out of the outer casing, a bolt connecting member that extends rearwardly from the bolt member, and a bolt resilient member that resiliently biases the bolt member to project out of the outer casing. The latch unit is disposed in the outer casing, and includes a latch member that is movable in the front-rear direction and that is operable to project out of the outer casing, a latch connecting member that extends rearwardly from the latch member, and a latch resilient member that is disposed on the latch connecting member and that resiliently biases the latch member to project out of the outer casing. The latch connecting member has a limiting portion at a rear end thereof. The auxiliary latch unit is disposed in the outer casing for abutting against the door frame, and includes an auxiliary latch member that is movable in the front-rear direction and that is operable to project out of the outer casing, a push seat that extends rearwardly from the auxiliary latch member, and an auxiliary latch resilient member that resiliently biases the auxiliary latch member to project out of the outer casing. The transmission unit is disposed in the outer casing, and includes a transmission plate that is movable in the front-rear direction, a plate resilient member that resiliently biases the transmission plate to move rearwardly, a lever member that is pivotally connected to the transmission plate, a lever resilient member that resiliently pushes the lever member, and a holding member that is pivotally connected to the outer casing. The lever member has a front arm portion that extends forwardly and that is for being pushed by the push seat, and a rear arm portion that extends rearwardly. The lever resilient member resiliently pushes the rear arm portion upwardly. The holding member has a hook portion. The door lock is operable to switch between an open state and a lock state. When the door lock is in the open state, the latch member and the auxiliary latch member project out of the outer casing, and the bolt member is retained in the outer casing by the hook portion of the holding member. When the door lock is in the lock state, the bolt member and the latch member project out of the outer casing, and the auxiliary latch member abuts against the door frame and is substantially retracted into the outer casing. During switching operation of the door lock from the open state to the lock state along with the closing operation of the door leaf, the latch member is pushed by the door frame to retract into the outer casing against the biasing action of the latch resilient member after the latch member comes into contact with the door frame so as to move the limiting portion of the latch connecting member past the rear arm portion of the lever member, and the auxiliary latch member is pushed by the door frame 200 to retract into the outer casing against the biasing action of the auxiliary latch resilient member to separate the push seat from the front arm portion of the lever member, so that the rear arm portion is moved onto the path of movement of the limiting portion of the latch connecting member by the lever resilient member. When the latch member is biased by the latch resilient member to project out of the outer casing again in order to engage the door frame after the door leaf is closed, the limiting portion of the latch connecting member pushes and moves the rear arm portion of the lever member to move the transmission plate forwardly against the biasing action of the plate resilient member, so that the holding member pivots downwardly and the hook portion of the holding member releases the bolt member and the bolt connecting member, thereby permitting the bolt member to be biased by the bolt resilient member to project out of the outer casing in order to engage the door frame.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
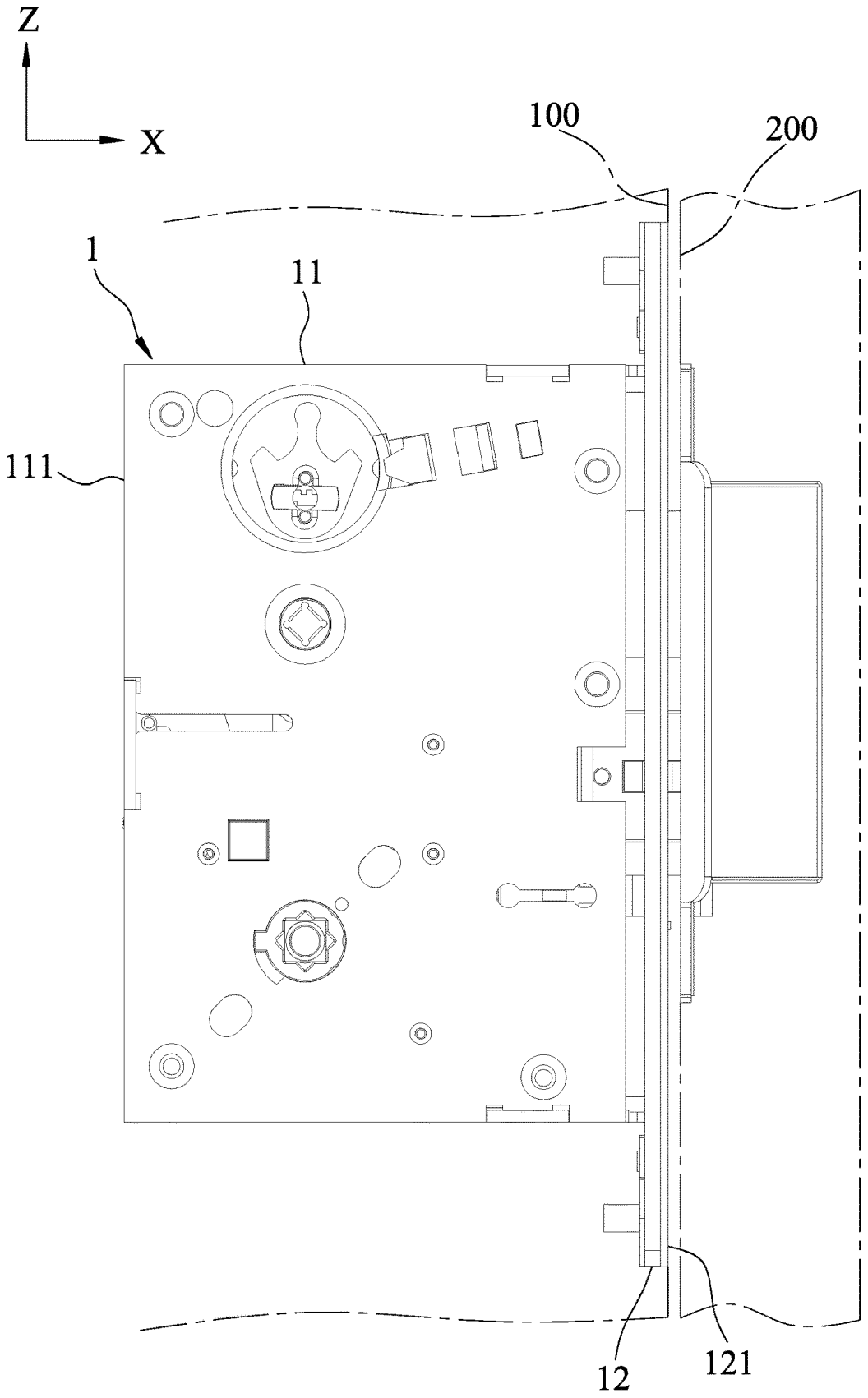
FIG. 1 is a side view illustrating an embodiment of a door lock according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
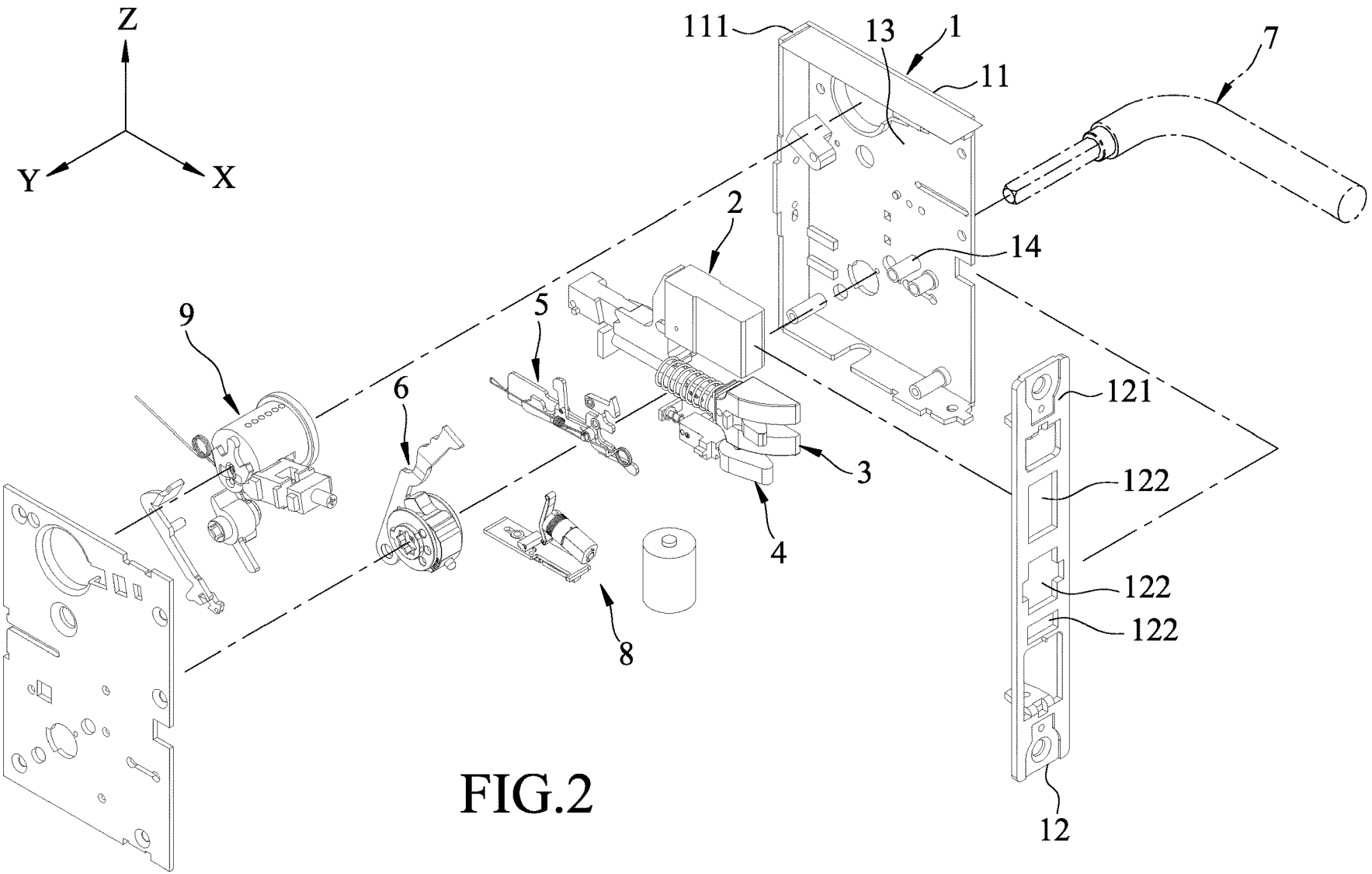
FIG. 2 is an exploded perspective view illustrating the embodiment.

Referring to FIGS. 1 and 2, an embodiment of the door lock according to the disclosure is adapted to be disposed on a door leaf 100 that is pivotally connected to a door frame 200, and includes an outer casing 1, a bolt unit 2, a latch unit 3, an auxiliary latch unit 4, a transmission unit 5, an electric lock unit 6, a handle unit 7, a control unit 8 and a lock core unit 9.

Figure 5:
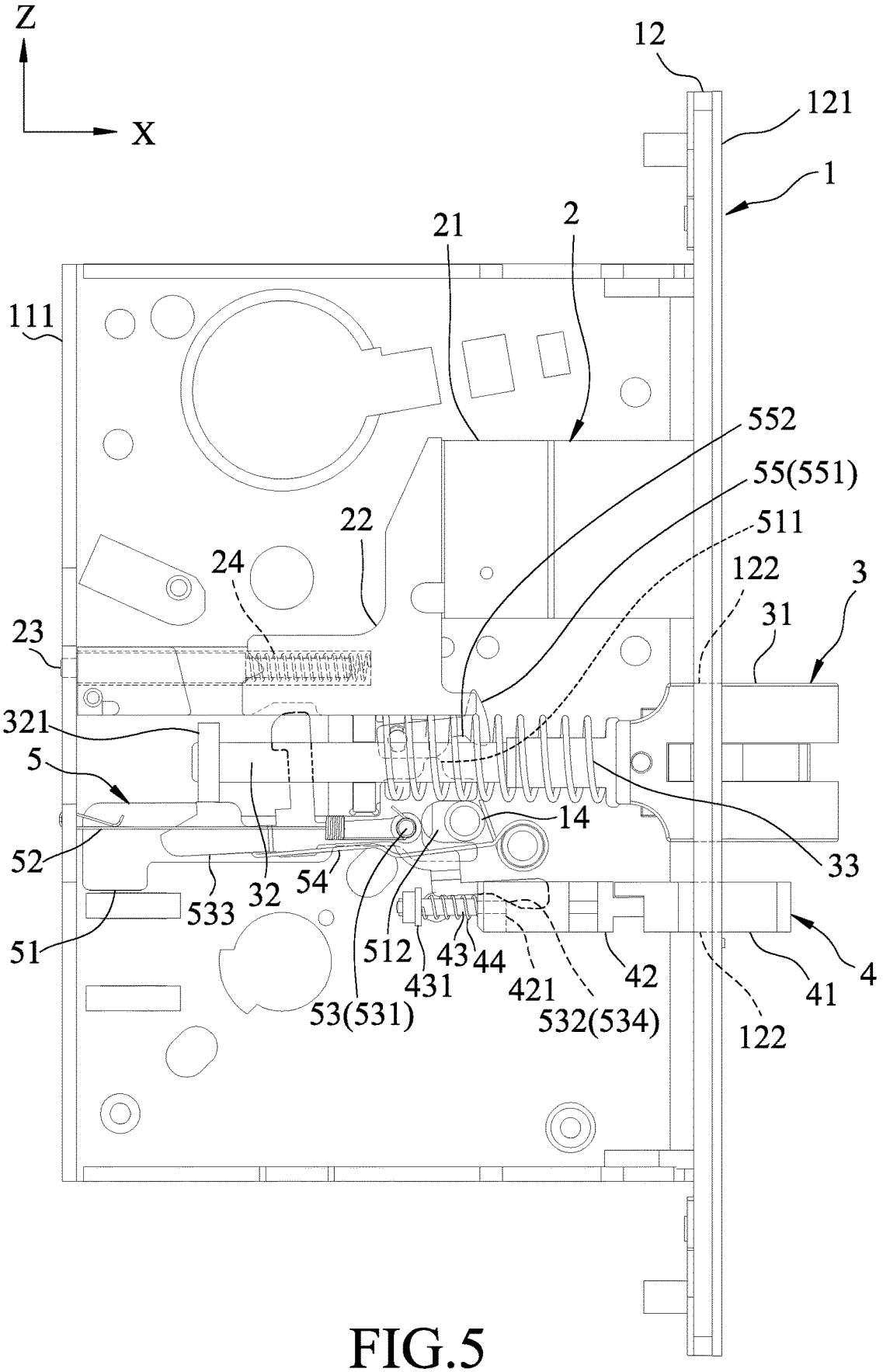
FIGS. 5 to 8 are side views illustrating the embodiment being switched from an open state to a lock state.

Referring to FIGS. 2 and 5, the outer casing 1 includes a main body 11, and a front plate 12 mounted to the main body 11. The main body 11 and the front plate 12 cooperatively define a retaining space 13. The main body 11 has a rear plate 111 that is spaced apart from the front plate 12 in a front-rear direction (X). The front plate 12 has a front surface 121 facing away from the rear plate 111, and is formed with a plurality of through grooves 122 extending through the front surface 121.

The bolt unit 2 is disposed in the outer casing 1, and includes a bolt member 21 that is movable in the front-rear direction (X) and that is operable to project out of the outer casing 1 through one of the through grooves 122, a bolt connecting member 22 that extends rearwardly from the bolt member 21, amounting rod 23 that is fixedly connected to the outer casing 1 and that permits the bolt connecting member 22 to be slidably sleeved thereon, and a bolt resilient member 24 that is sleeved on the mounting rod 23 and that resiliently biases the bolt member 21 (via the bolt connecting member 22) to project out of the outer casing 1. In one embodiment, the bolt resilient member 24 is a compression spring.

The latch unit 3 is disposed in the outer casing 1, and is located below the bolt unit 2 in a top-bottom direction (Z). The latch unit 3 includes a latch member 31 that is movable in the front-rear direction (X) and that is operable to project out of the outer casing 1 through another one of the through grooves 122, a latch connecting member 32 that is co-movably connected to the latch member 31 and that extends rearwardly from the latch member 31, and a latch resilient member 33 that is sleeved on the latch connecting member 32 and that resiliently biases the latch member 31 to project out of the outer casing 1. The latch connecting member 32 has a rectangular limiting portion 321 at a rear end thereof. In one embodiment, the latch resilient member 33 is a compression spring.

The auxiliary latch unit 4 is disposed in the outer casing 1, and is for abutting against the door frame 200. The auxiliary latch unit 4 is located below the latch unit 3, and includes an auxiliary latch member 41 that is movable in the front-rear direction (X) and that is operable to project out of the outer casing 1 through still another one of the through grooves 122, a push seat 42 that extends rearwardly from the auxiliary latch member 41, a mounting seat 43 that is fixedly connected to the outer casing 1 and that permits the push seat 42 to be slidably disposed thereon, and an auxiliary latch resilient member 44 that resiliently biases the auxiliary latch member 41 (via the push seat 42) to project out of the outer casing 1. The push seat 42 has a push protrusion 421 (see FIG. 4) that extends in an inner-outer direction (Y) perpendicular to the front-rear direction (X). In one embodiment, the auxiliary latch resilient member 44 is a compression spring, and has an end abutting against a plate portion 431 (see FIG. 3) of the mounting seat 43, and an opposite end retained in the push seat 42 and abutting against the push seat 42.

In this embodiment, the mounting seat 43 is configured as a rod on which the push seat 42 is mounted. In a modification, the mounting seat 43 may be configured to have a guide rail or a guide slot that permits the push seat 42 to slidably engage therewith.

The transmission unit 5 is disposed in the outer casing 1, and includes a transmission plate 51 that is movable in the front-rear direction (X), a plate resilient member 52 that resiliently biases the transmission plate 51 to move rearwardly (i.e., away from the front plate 12), a lever member 53 that is pivotally connected to the transmission plate 51, a lever resilient member 54 that resiliently pushes the lever member 53, and a holding member 55 that is pivotally connected to the outer casing 1. The transmission plate 51 has a top protrusion 511 that is in slidable contact with the holding member 55, and a positioning groove 512 that is located below the top protrusion 511 and that is operable to be engaged with a post 14 (see FIG. 2) of the outer casing 1. The plate resilient member 52 has two opposite ends respectively connected to the rear plate 111 of the main body 11 and the transmission plate 51, and resiliently draws the transmission plate 51 toward the rear plate 111. The lever member 53 has a pivot portion 531 pivotally connected to the transmission plate 51, a front arm portion 532 extending forwardly from the pivot portion 531, and a rear arm portion 533 extending rearwardly from the pivot portion 531. The front arm portion 532 has an inclined surface 534 that faces the push protrusion 421 of the push seat 42 and that is for being pushed by the push protrusion 421. The lever resilient member 54 is a torsion spring, and has two legs respectively abutting against the rear arm portion 533 of the lever member 53 and the post 14 of the outer casing 1 for resiliently pushing the rear arm portion 533 upwardly. The holding member 55 is located above the transmission plate 51, and has a hook portion 551 and a recess 552.

Figure 6:
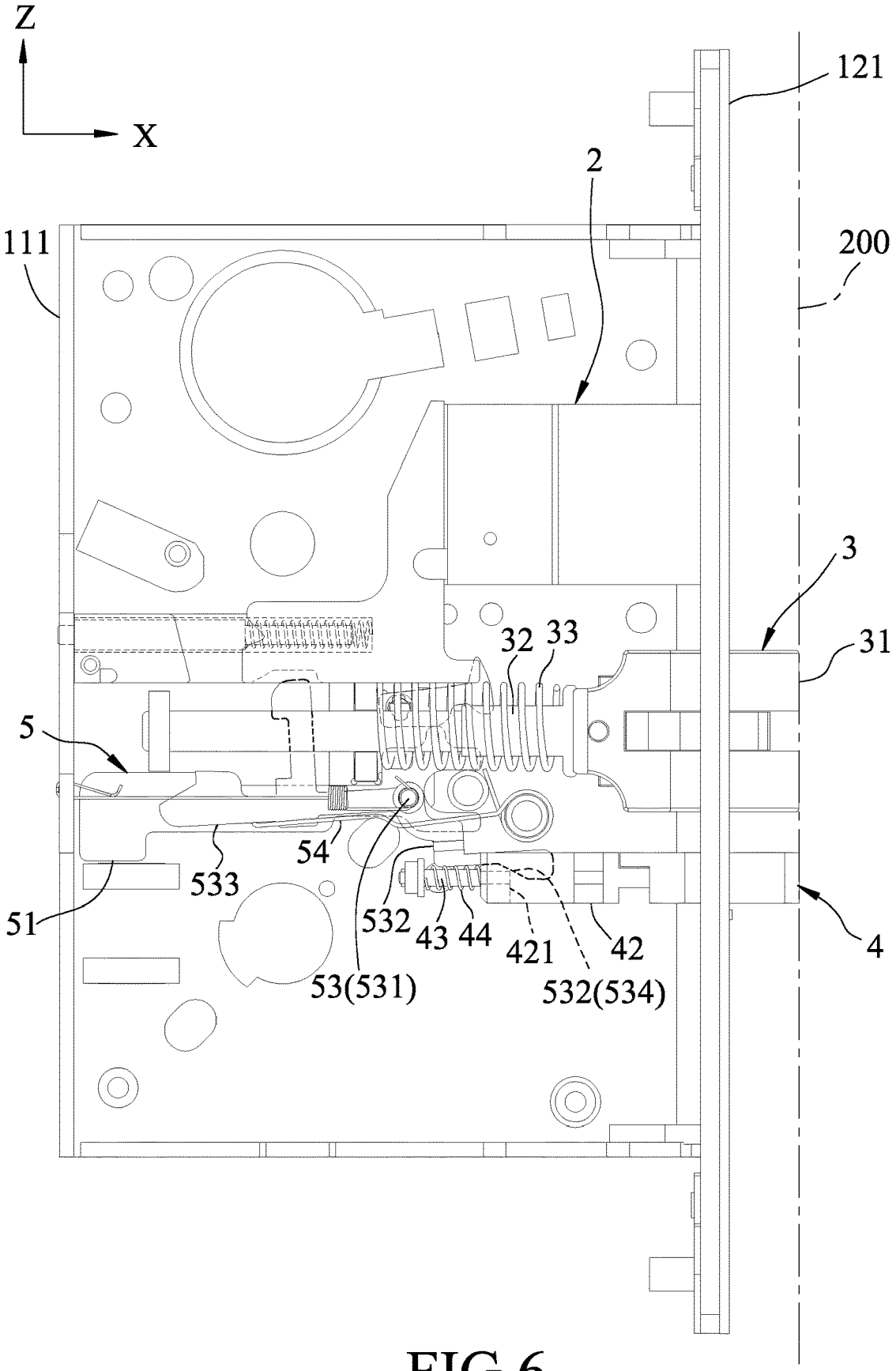
Figure 7:
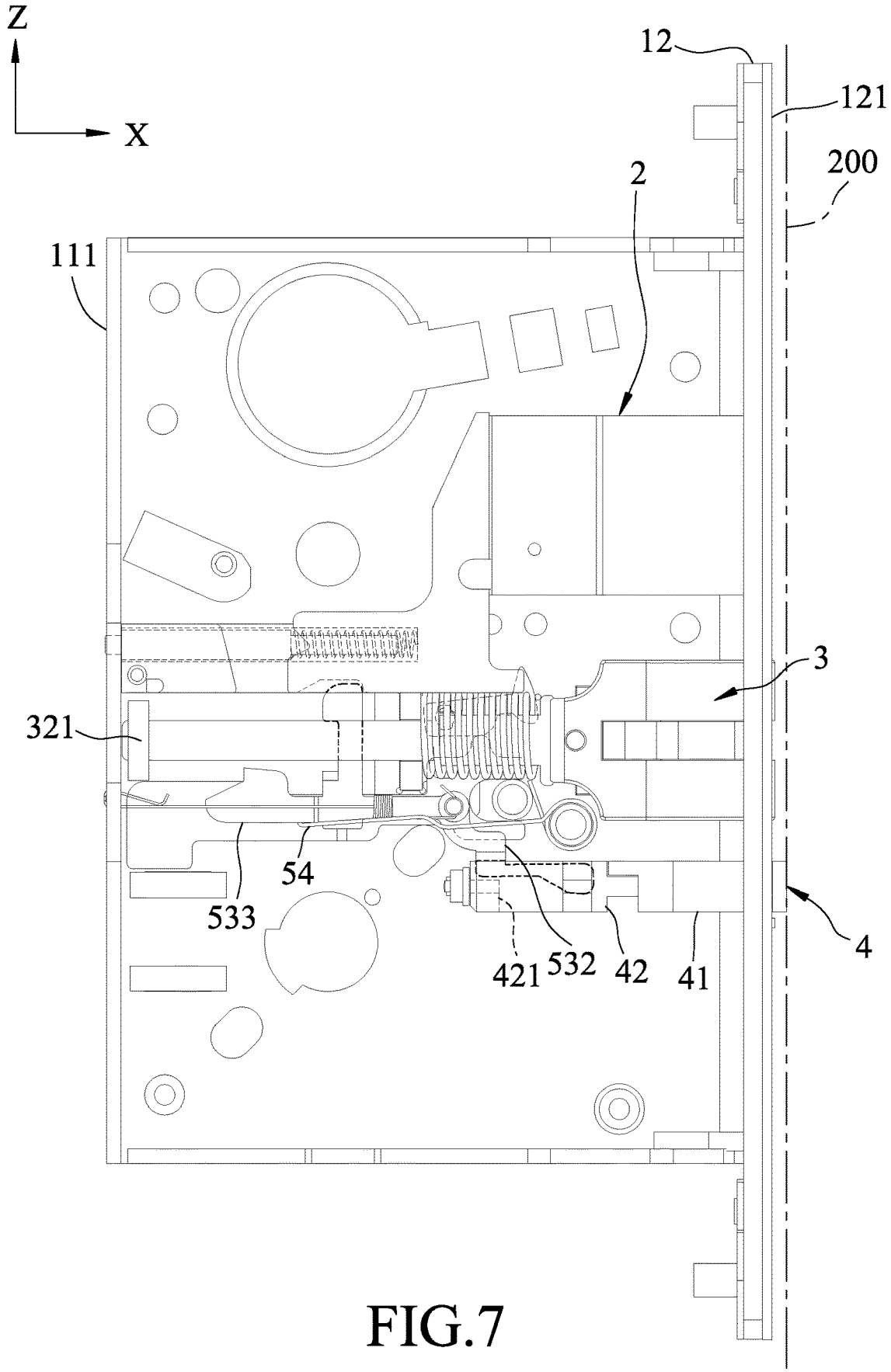
Figure 8:
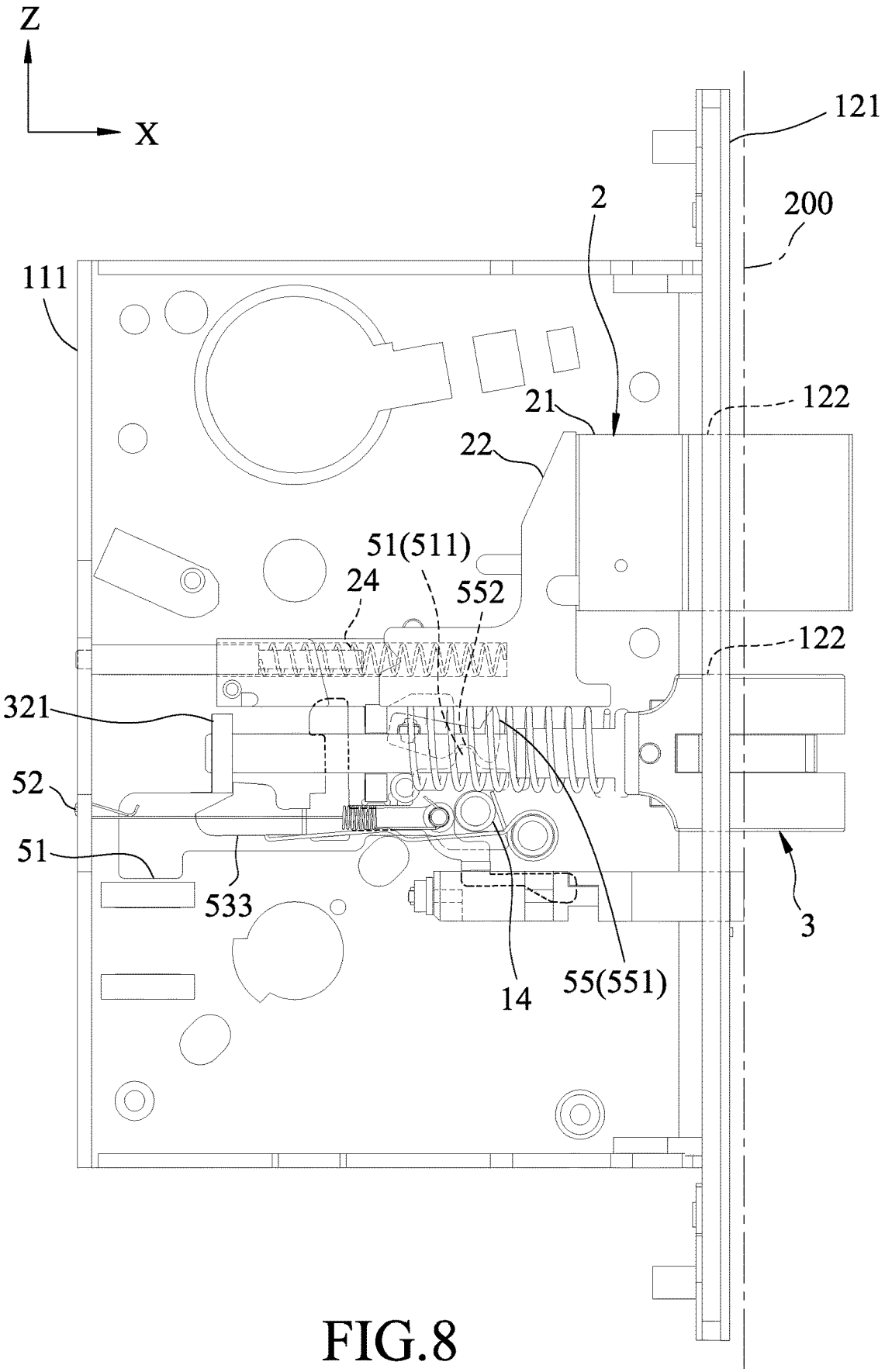
Figure 9:
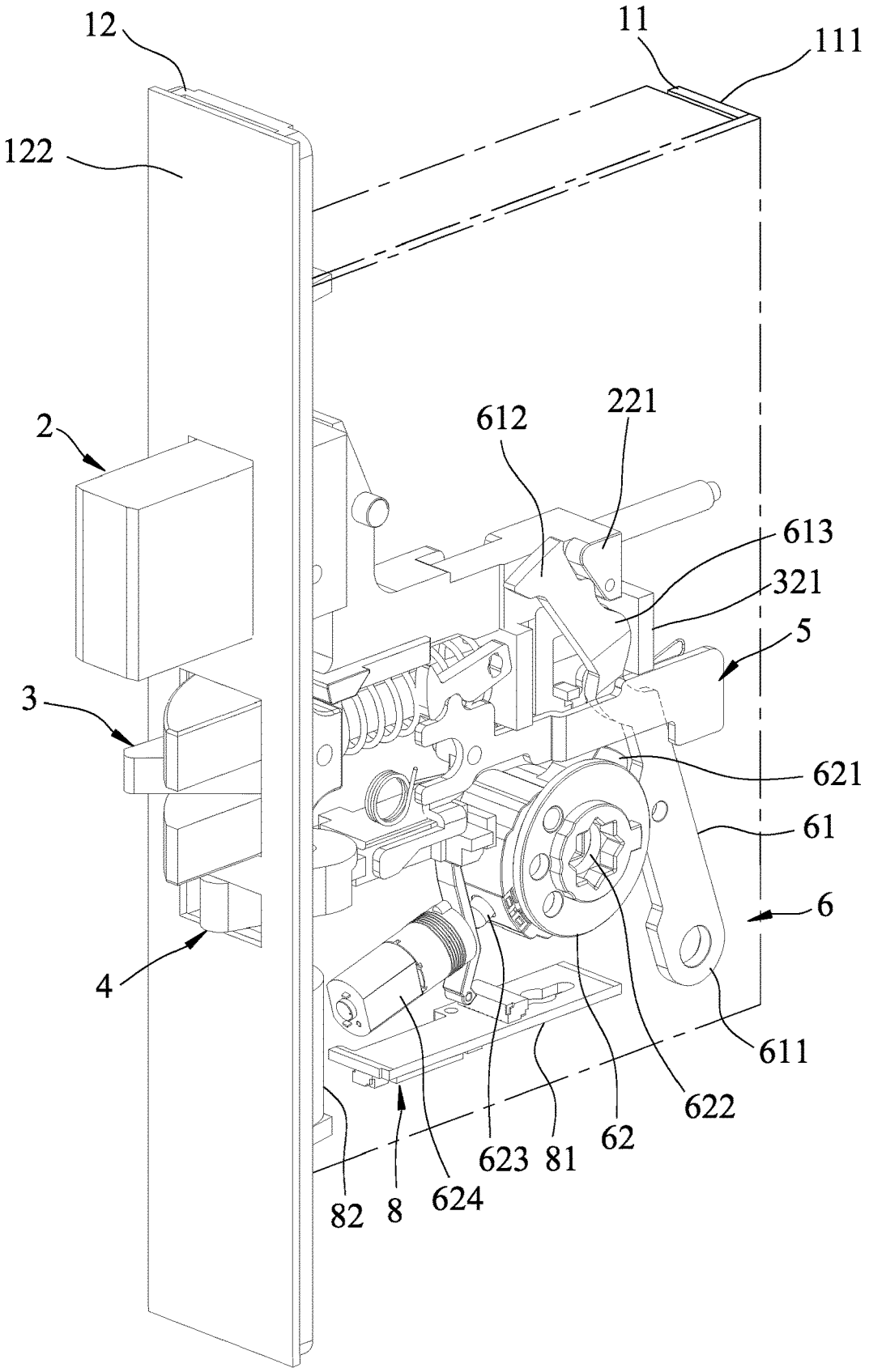
FIG. 9 is a perspective view of the embodiment illustrating an electric lock unit and a control unit.

Referring to FIGS. 5 to 8, the door lock is operable to switch between an open state (see FIGS. 3 to 5) and a lock state (see FIG. 8). The door lock is in the open state when the door leaf 100 is opened, and is in the lock state when the door leaf 100 is closed.

Figure 3:
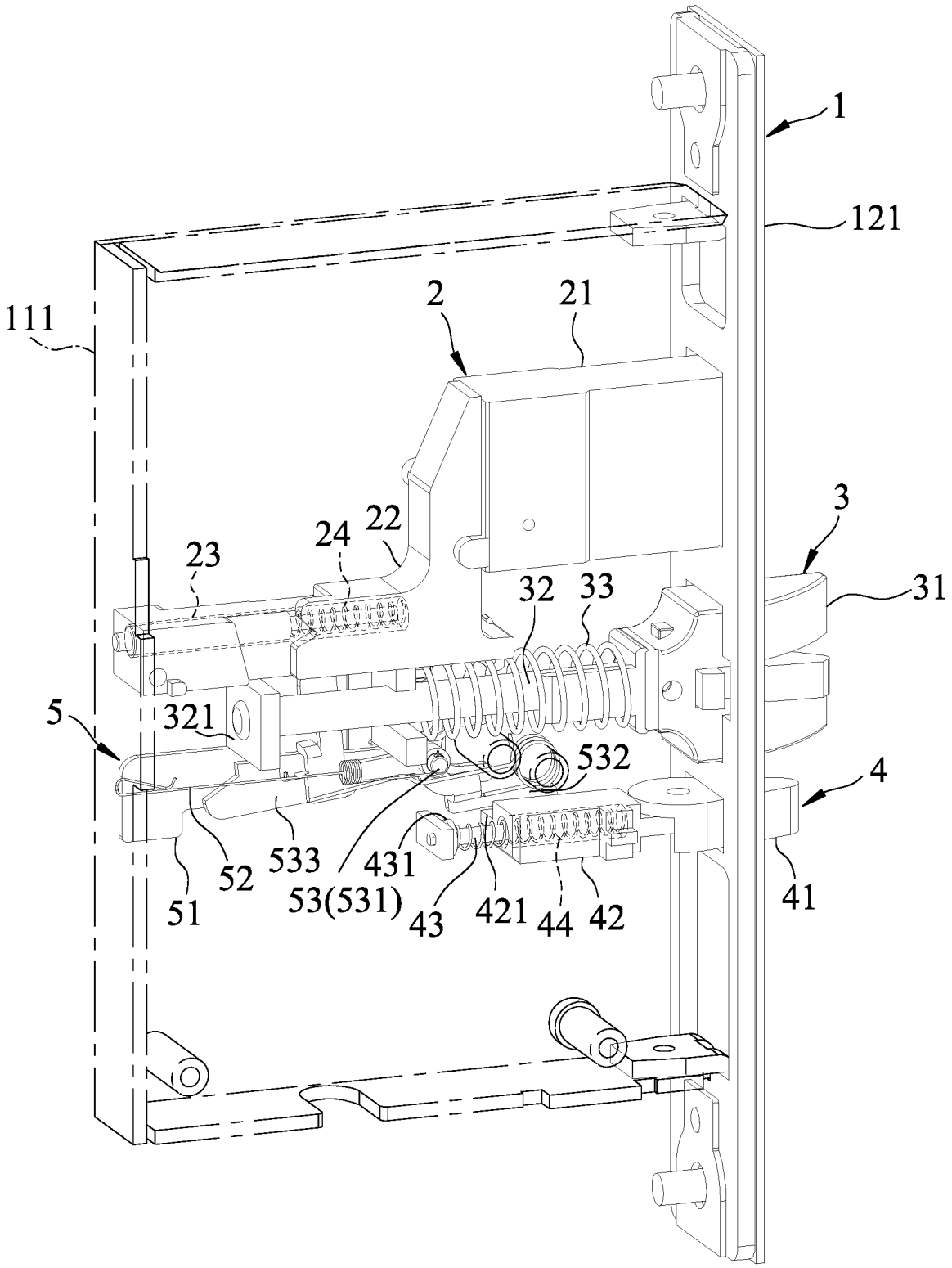
FIG. 3 is a perspective view illustrating the embodiment.
Figure 4:
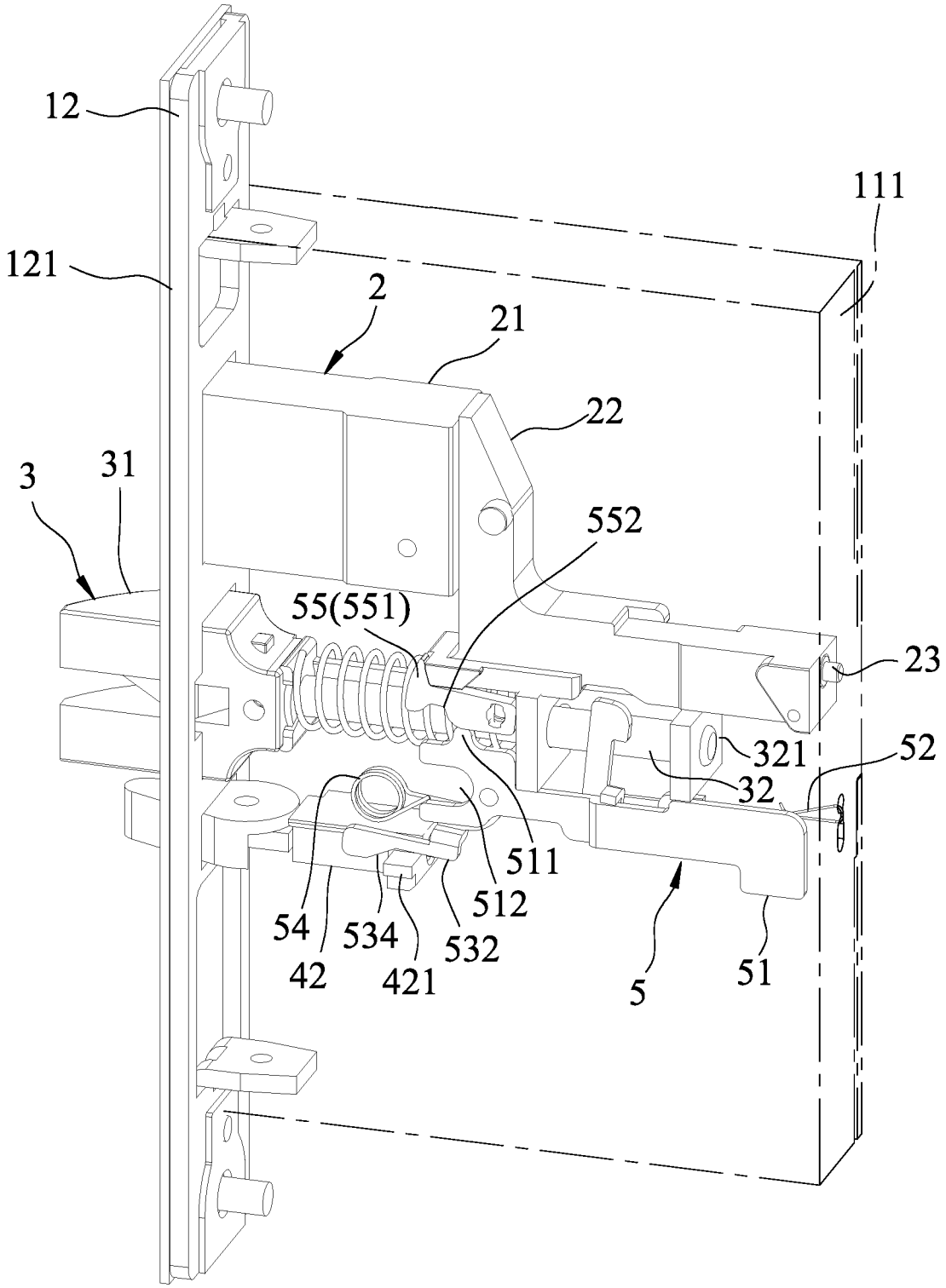
FIG. 4 is another perspective view illustrating the embodiment.

With particular reference to FIGS. 3 to 5, when the door lock is in the open state, the latch member 31 and the auxiliary latch member 41 project out of the outer casing 1 respectively through the corresponding through grooves 122, the bolt member 21 is retracted into the outer casing 1, the top protrusion 511 of the transmission plate 51 is separated from the recess 552 of the holding member 55 and pushes the holding member 55 so that the bolt member 21 and the bolt connecting member 22 are held by the hook portion 551 of the holding member 55, the positioning groove 512 of the transmission plate 51 is separated from the post 14 of the outer casing 1, and the push protrusion 421 of the push seat 42 pushes the front arm portion 532 of the lever member 53 so that the rear arm portion 533 is moved downwardly against the biasing action of the lever resilient member 54 to be removed from the path of movement of the limiting portion 321 of the latch connecting member 32.

With particular reference to FIG. 8, when the door lock is in the lock state, the bolt member 21 and the latch member 31 project out of the outer casing 1 respectively through the corresponding through grooves 122, and the auxiliary latch member 41 abuts against the door frame 200 and is substantially retracted in to the outer casing 1.

Referring to FIG. 6, during the closing operation of the door leaf 100, the latch member 31 is pushed by the door frame 200 to retract into the outer casing 1 against the biasing action of the latch resilient member 33 after the latch member 31 comes into contact with the door frame 200. Referring to FIG. 7, after the limiting portion 321 of the latch connecting member 32 moves past the rear arm portion 533 of the lever member 53, the auxiliary latch member 41 comes into contact with the door frame 200, and is pushed by the door frame 200 to retract into the outer casing 1 against the biasing action of the auxiliary latch resilient member 44. The push protrusion 421 of the push seat 42 moves rearwardly along with the movement of the auxiliary latch member 41 to be separated from the inclined surface 534 of the front arm portion 532 of the lever member 53, so that the rear arm portion 533 is moved onto the path of movement of the limiting portion 321 of the latch connecting member 32 by the lever resilient member 54. Referring to FIG. 8, after the door leaf 100 is closed, the latch member 31 is biased by the latch resilient member 33 to project out of the outer casing 1 again to engage a groove in the door frame 200. The limiting portion 321 of the latch connecting member 32 moves along with the forward movement of the latch member 31 to push and move the rear arm portion 533 of the lever member 53, so as to move the transmission plate 51 forwardly against the biasing action of the plate resilient member 52 for engaging the positioning groove 512 with the post 14. Along with the forward movement of the transmission plate 51, the top protrusion 511 of the transmission plate 51 is moved to correspond in position to the recess 552 of the holding member 55, and the holding member 55 therefore pivots downwardly to engage the recess 552 with the top protrusion 511 so that the hook portion 551 of the holding member 55 releases the bolt member 21 and the bolt connecting member 22 and that the bolt member 21 is biased to project out of the outer casing 1 by the bolt resilient member 24 to engage another groove in the door frame 200. As such, when the door leaf 100 is closed, the bolt member 21 automatically engage the door frame 200 to lock the door leaf 100 without additional manual operation.

Referring to FIGS. 9 to 13, the door lock according to the disclosure can be unlocked via a card (not shown) with a tag containing identification data for opening the door leaf 100.

The electric lock unit 6 includes a push arm 61 and a driving module 62. The push arm 61 has a pivot portion 611 that is pivotally connected to the outer casing 1, a first push portion 612 that is opposite to the pivot portion 611 and that is for pushing the bolt connecting member 22, and a second push portion 613 that is located between the pivot portion 611 and the first push portion 612 and that is for pushing the limiting portion 321 of the latch connecting member 32. The bolt connecting member 22 has a protruding block 221 (see FIG. 9) at a rear end thereof for being pushed by the push arm 61. The driving module 62 includes an outer driving member 621 for driving movement of the push arm 61, an inner driving member 622 that is rotatably mounted in the outer driving member 621, a pin member 623 that is movably mounted in the outer driving member 621 and the inner driving member 622, and an actuator 624 for moving the pin member 623.

The handle unit 7 includes a handle 71 that is coupled to the inner driving member 622 of the driving module 62 of the electric lock unit 6 and that is operable to drive rotation of the inner driving member 622. When the pin member 623 is moved by the actuator 624 to engage both of the outer driving member 621 and the inner driving member 622, rotation of the inner driving member 622 drives the outer driving member 621 to push and rotate the push arm 61.

The control unit 8 is electrically coupled to the electric lock unit 6, and includes a circuit board 81 that is electrically coupled to the actuator 624 to control the actuator 624, and a battery 82 that is electrically coupled to the circuit board 81 for providing electric power.

Figure 10:
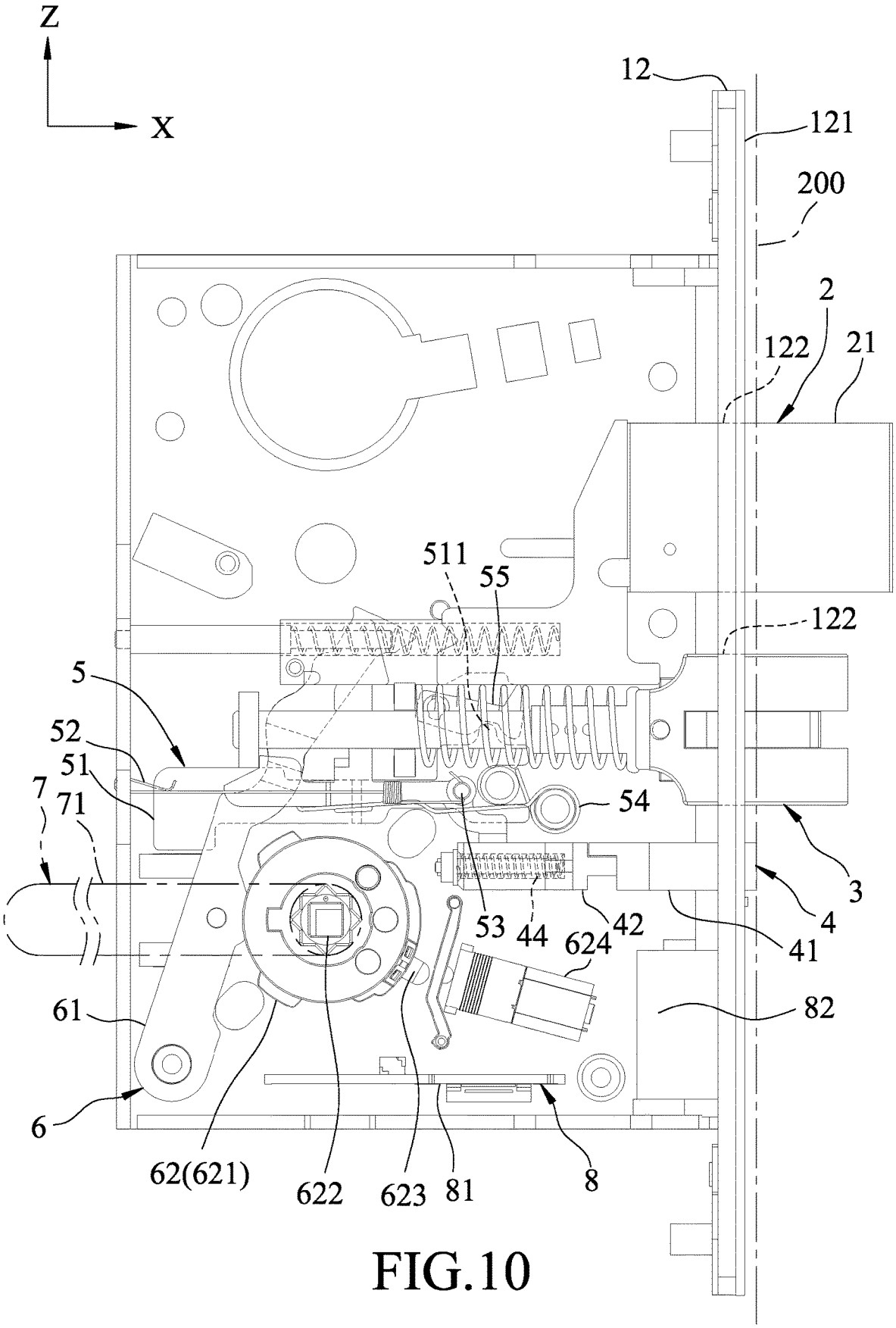
FIGS. 10 to 13 are side views illustrating the embodiment being switched from the lock state to the open state via the electric lock unit and the control unit.
Figure 11:
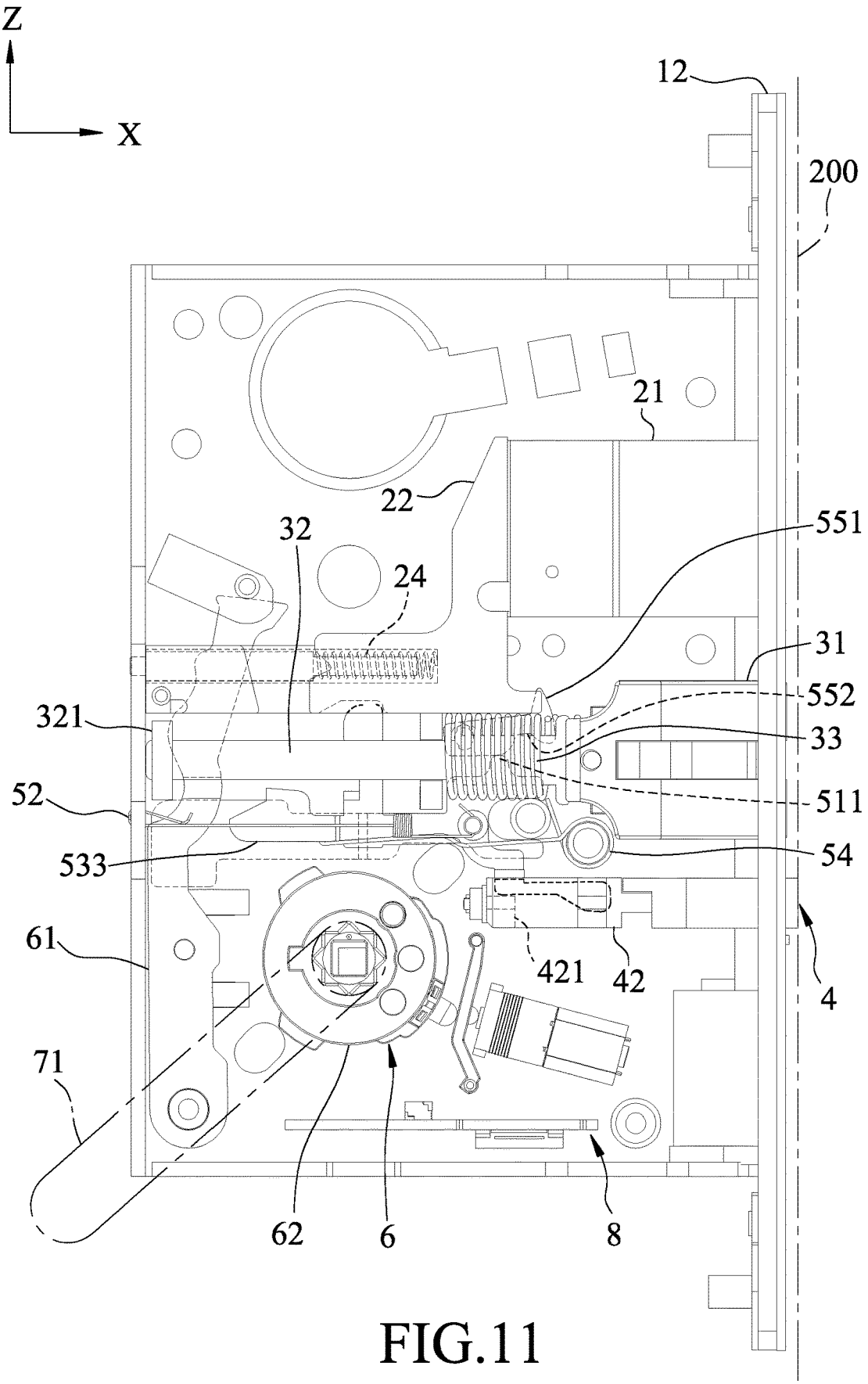
Figure 12:
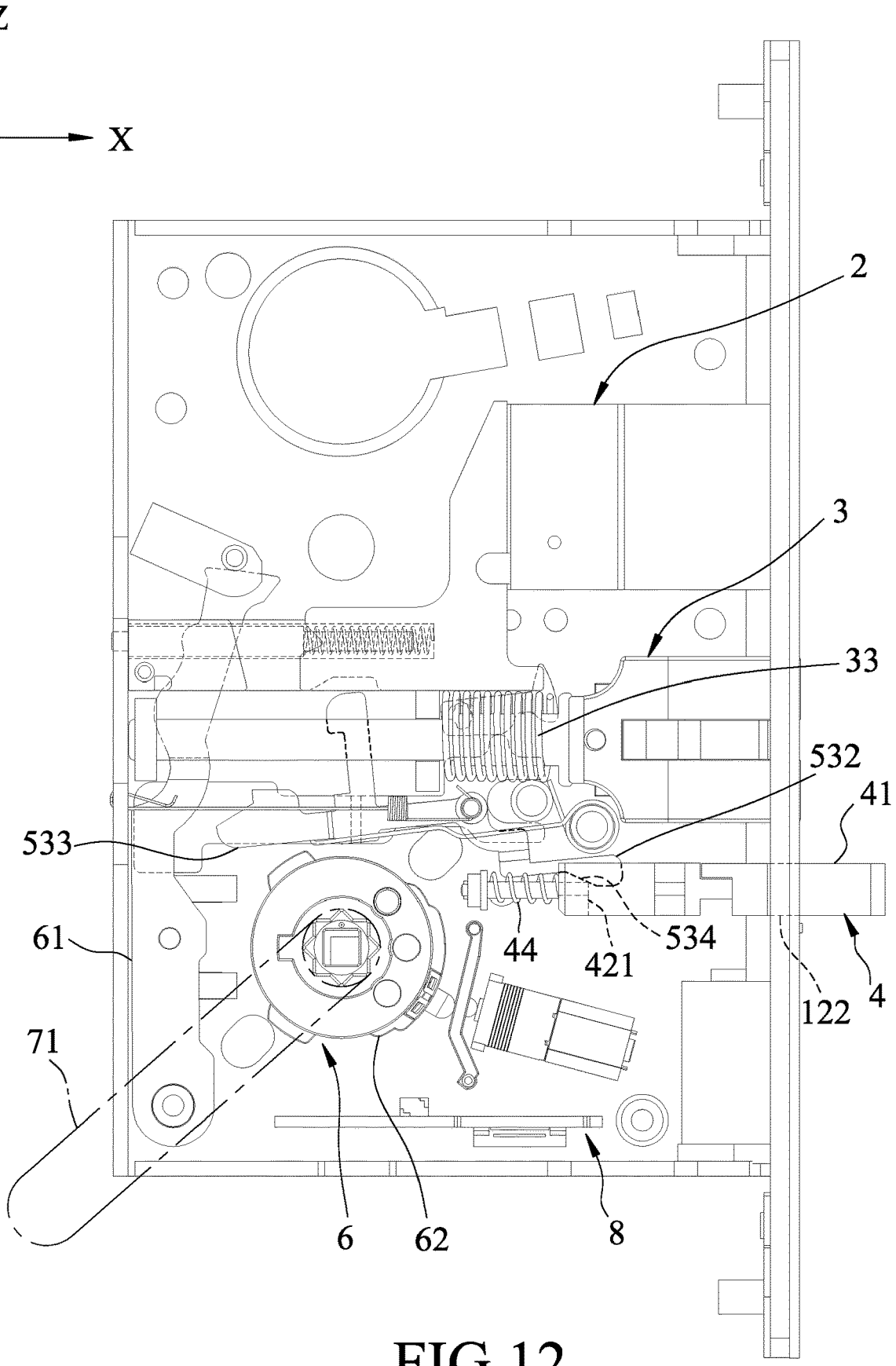
Figure 13:
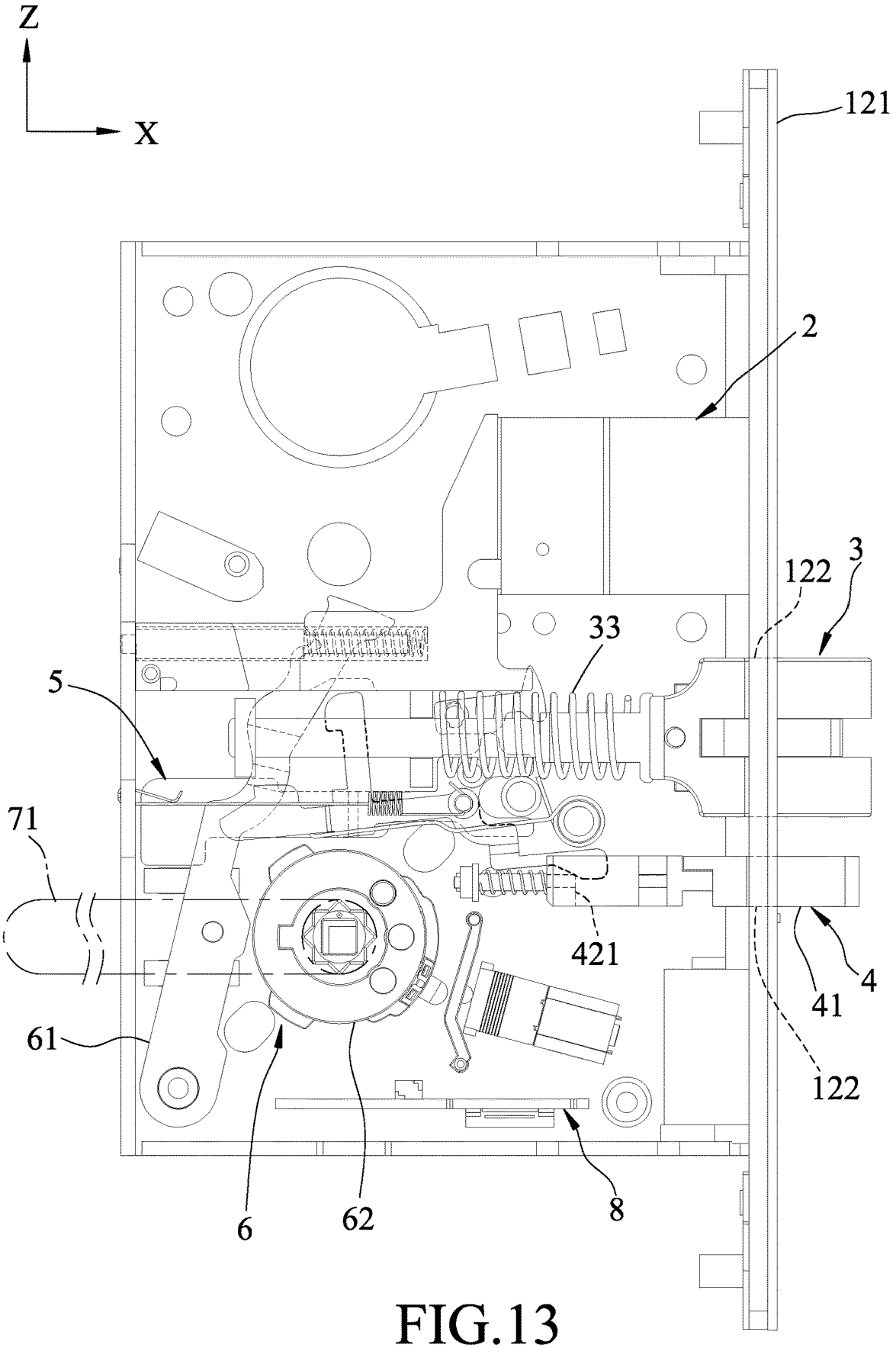
Figure 14:
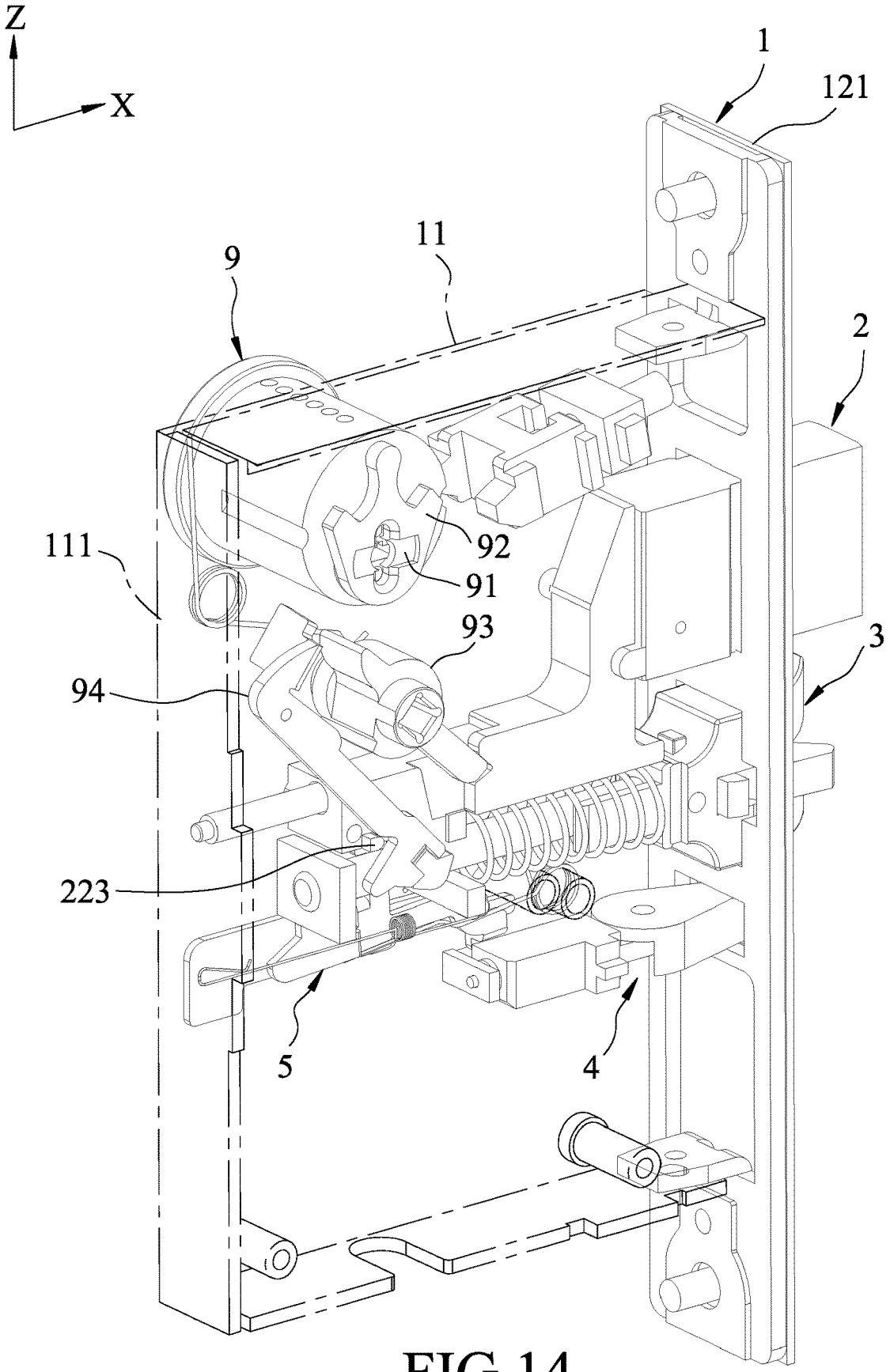
FIG. 14 is a perspective view of the embodiment illustrating a lock core unit.

Referring to FIG. 10, when the door leaf 100 is closed, the door lock is in the lock state, and the pin member 623 does not engage the outer driving member 621. When the card is moved to the proximity of the door lock for opening the door leaf 100, the circuit board 81 identifies the data in the card, and controls the actuator 624 to move the pin member 623 so that the pin member 623 engages both of the outer driving member 621 and the inner driving member 622. Referring to FIG. 11, at this time, rotation of the handle 71 drives the push arm 61 to push and move the bolt connecting member 22 and the latch connecting member 32 rearwardly against the biasing action of the bolt resilient member 24 and the latch resilient member 33 to retract the bolt member 21 and the latch member 31 into the outer casing 1. When the limiting portion 321 of the latch connecting member 32 is separated from the rear arm portion 533 of the lever member 53, the plate resilient member 52 biases the transmission plate 51 to move rearwardly, and the top protrusion 511 of the transmission plate 51 is therefore separated from the recess 552 of the holding member 55 and pushes the holding member 55 to pivot upwardly, so that the bolt member 21 and the bolt connecting member 22 are held by the hook portion 551 of the holding member 55, and that the bolt member 21 is retained within the outer casing 1. Referring to FIG. 12, when the door leaf 100 is opened with the handle 71 being held, the auxiliary latch resilient member 44 biases the push seat 42 forwardly to move the auxiliary latch member 41 to project out of the outer casing 1. The push protrusion 421 of the push seat 42 moves forwardly along with the movement of the auxiliary latch member 41 to contact and push the inclined surface 534 of the front arm portion 532 of the lever member 53 to rotate the lever member 53, so that the rear arm portion 533 is removed from the path of movement of the limiting portion 321 of the latch connecting member 32 against the biasing action of the lever resilient member 54. Referring to FIG. 13, when the handle 71 is released, the latch member 31 is biased by the latch resilient member 33 to project out of the outer casing 1.

In one embodiment, the circuit board 81 of the control unit 8 may be signally coupled to a portable device (e.g., a mobile phone) that is operable to emit an open signal. When the circuit board 81 receives the open signal, it controls the actuator 624 to move the pin member 623 to engage both of the outer driving member 621 and the inner driving member 622 for opening the door leaf 100.

Referring to FIGS. 14 to 19, the door lock according to the disclosure can be unlocked further via a key (not shown) for opening the door leaf 100.

Figure 15:
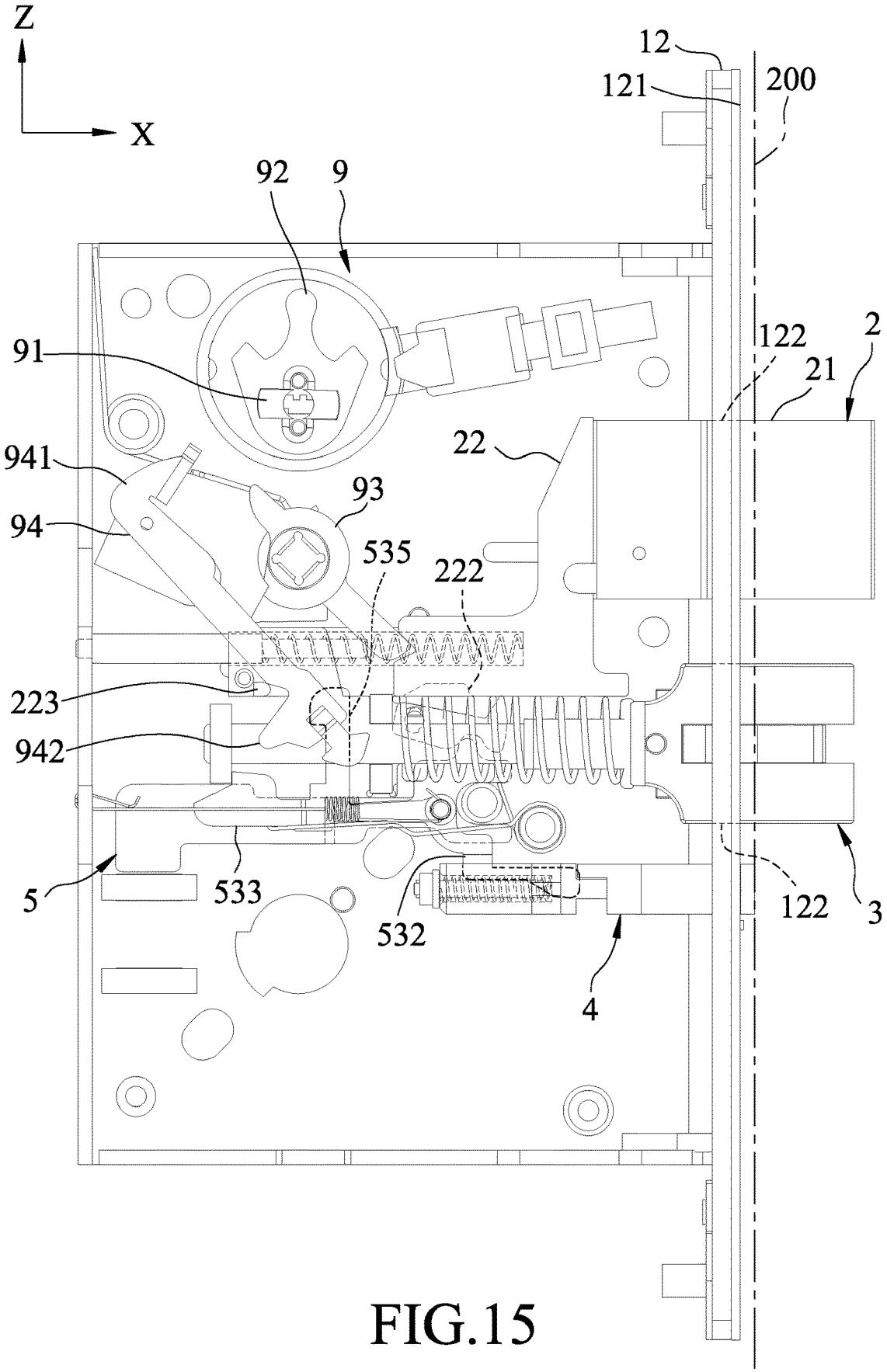
FIGS. 15 to 19 are side views illustrating the embodiment being switched from the lock state to the open state via the lock core unit.

The lock core unit 9 is disposed in the outer casing 1, and includes lock core 91 that permits the key to be inserted therein and that is rotated by the key, a push member 92 that is co-rotatably mounted to the lock core 91, a bolt push arm 93 that is pivotally connected to the outer casing 1 and that is for pushing the bolt connecting member 22, and a latch push arm 94 that is pivotally connected to the outer casing 1 and that is for pushing the latch connecting member 32. The latch push arm 94 has a center of gravity located below a pivot point thereof and tends to be uprightly-disposed. The latch push arm 94 has an upper arm portion 941 located above the pivot point and a lower arm portion 942 located below the pivot point. The lever member 53 of the transmission unit 5 further has an extending arm portion 535 that extends upwardly from the rear arm portion 533. The bolt connecting member 22 further has a push surface 222 that faces rearwardly, and a support protrusion 223 at the rear end thereof for supporting the lower arm portion 942 of the latch push arm 94. Referring to FIG. 15, when the door lock is in the lock state, the extending arm portion 535 of the lever member 53 is located on the path of movement of the push surface 222 of the bolt connecting member 22, and the lower arm portion 942 of the latch push arm 94 is supported by the support protrusion 223 so that the latch push arm 94 is inclined (the center of gravity of the latch push arm 94 is ascended) and that the upper arm portion 941 is not located on the path of movement of the push member 92.

Figure 16:
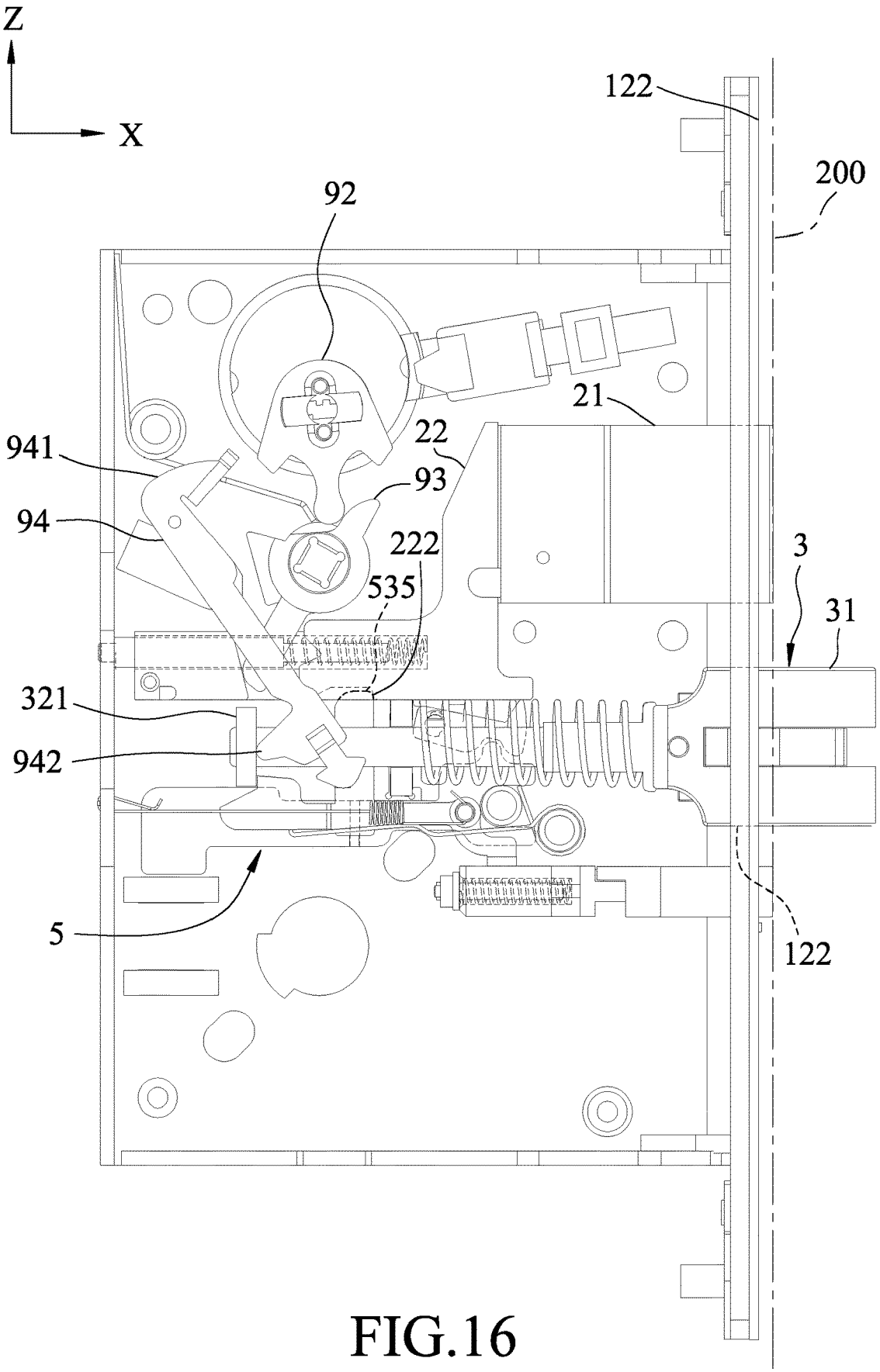
Figure 17:
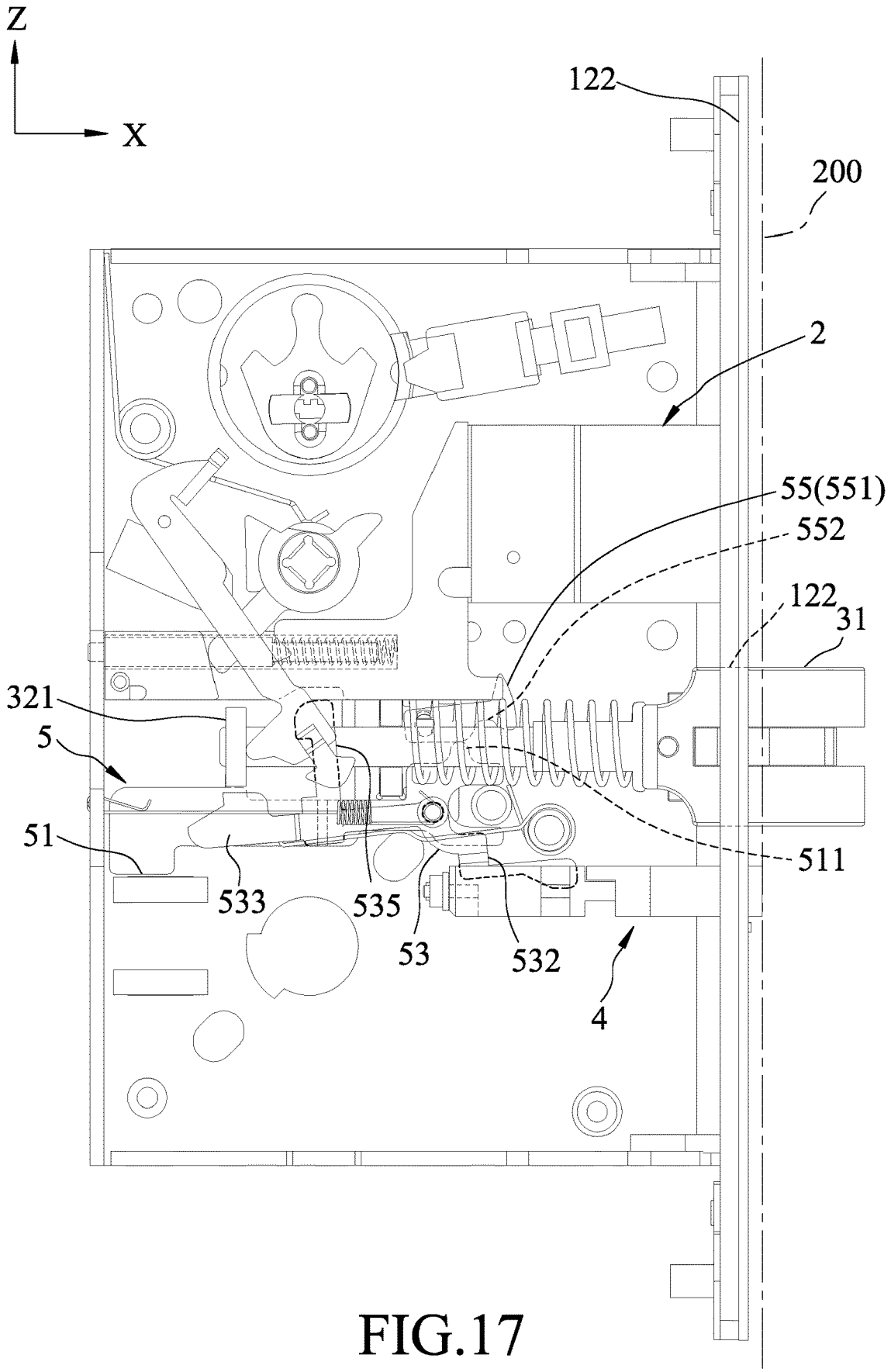
Figure 18:
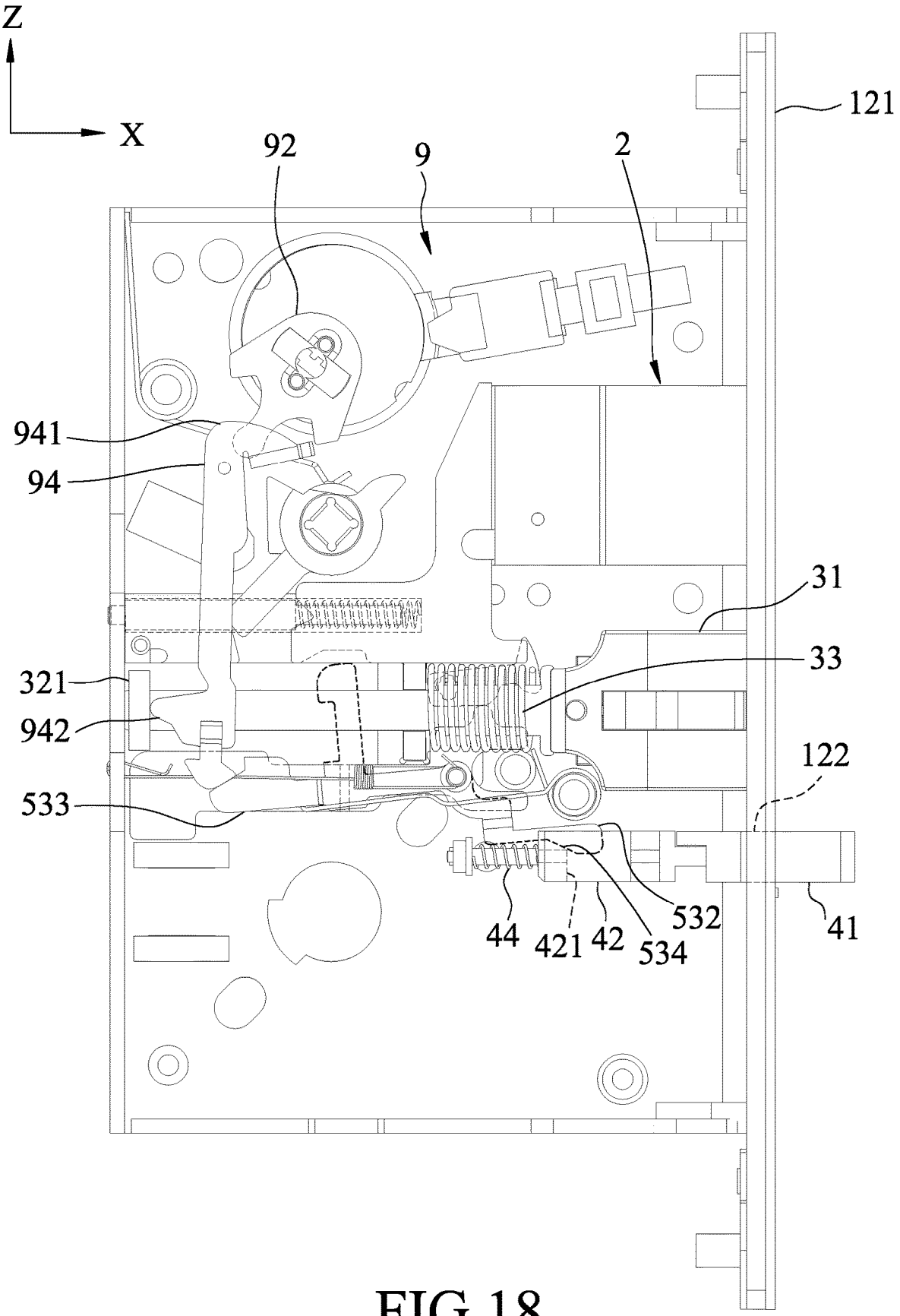
Figure 19:
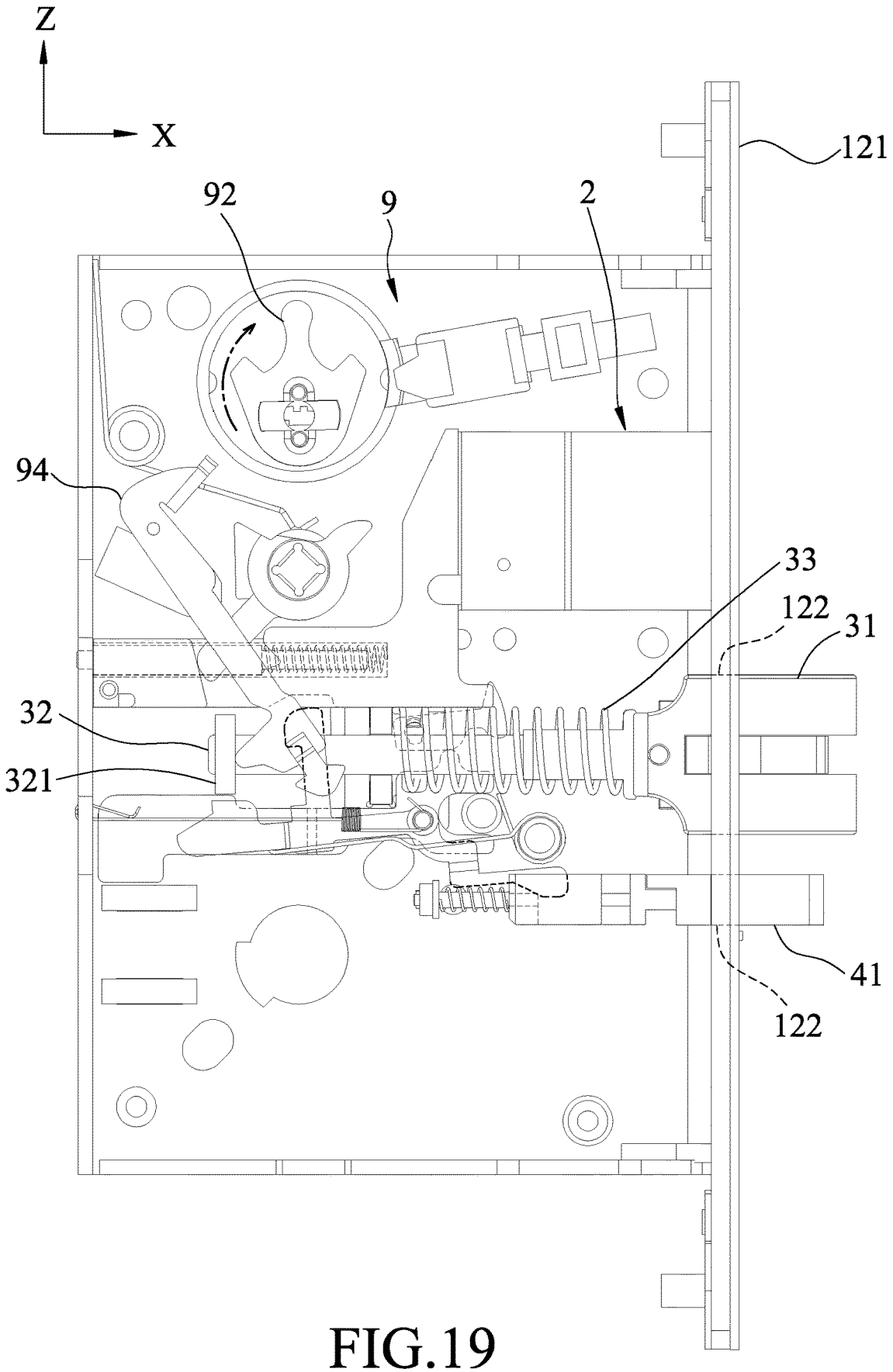

Referring to FIG. 16, when the push member 92 is rotated counterclockwise by the key, the bolt push arm 93 is pushed by the push member 92 to rotate clockwise so as to push and move the bolt connecting member 22 rearwardly. The support protrusion 223 is separated from the lower arm portion 942 of the latch push arm 94 along with the rearward movement of the bolt connecting member 22, so that the latch push arm 94 rotates clockwise (due to the descent of the center of gravity thereof) until the lower arm portion 942 abuts against the limiting portion 321 of the latch connecting member 32 so as to move the upper arm portion 941 onto the path of movement of the push member 92. Referring to FIG. 17, with further rearward movement of the bolt connecting member 22, the push surface 222 of the bolt connecting member 22 pushes the extending arm portion 535 of the lever member 53 to rotate the lever member 53, so that the rear arm portion 533 is removed from the path of movement of the limiting portion 321 of the latch connecting member 32 against the biasing action of the lever resilient member 54. As such, the plate resilient member 52 biases the transmission plate 51 to move rearwardly, and the top protrusion 511 of the transmission plate 51 is therefore separated from the recess 552 of the holding member 55 and pushes the holding member 55 to pivot upwardly, so that the bolt member 21 and the bolt connecting member 22 are held by the hook portion 551 of the holding member 55 to be retained within the outer casing 1. Referring to FIG. 18, with further counterclockwise rotation of the lock core 91, the push member 92 pushes the upper arm portion 941 of the latch push arm 94 to rotate the latch push arm 94 clockwise, so that the lower arm portion 942 of the latch push arm 94 pushes and moves the limiting portion 321 of the latch connecting member 32 rearwardly against the biasing action of the latch resilient member 33 to retract the latch member 31 into the outer casing 1 for opening the door leaf 100. Referring to FIG. 19, when the door leaf 100 is opened, the auxiliary latch resilient member 44 biases the push seat 42 forwardly to move the auxiliary latch member 41 to project out of the outer casing 1. By rotating the lock core 91 clockwise, the push member 92 is separated from the upper arm portion 941 of the latch push arm 94, so that the latch member 31 is biased by the latch resilient member 33 to project out of the outer casing 1, and the latch push arm 94 is pushed by the limiting portion 321 of the latch connecting member 32 to be inclined-disposed.

In summary, the door lock according to the disclosure is automatically locked when the door leaf 100 is closed, and can be unlocked by virtue of the card with a tag containing identification data or the kay.

In a modification, the electric lock unit 6 and the control unit 8 may be omitted. In another modification, the lock core unit 9 may be omitted.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A door lock adapted to be disposed on a door leaf, the door leaf being pivotally connected to a door frame, said door lock comprising:

an outer casing defining a retaining space therein, and including a front plate, and a rear plate that is spaced apart from said front plate in a front-rear direction;

a bolt unit disposed in said outer casing, and including a bolt member that is movable in the front-rear direction and that is operable to project out of said outer casing, a bolt connecting member that extends rearwardly from said bolt member, and a bolt resilient member that resiliently biases said bolt member to project out of said outer casing;

a latch unit disposed in said outer casing, and including a latch member that is movable in the front-rear direction and that is operable to project out of said outer casing, a latch connecting member that extends rearwardly from said latch member, and a latch resilient member that is disposed on said latch connecting member and that resiliently biases said latch member to project out of said outer casing, said latch connecting member having a limiting portion at a rear end thereof;

an auxiliary latch unit disposed in said outer casing for abutting against the door frame, and including an auxiliary latch member that is movable in the front-rear direction and that is operable to project out of said outer casing, a push seat that extends rearwardly from said auxiliary latch member, and an auxiliary latch resilient member that resiliently biases said auxiliary latch member to project out of said outer casing; and a transmission unit disposed in said outer casing, and including a transmission plate that is movable in the front-rear direction, a plate resilient member that resiliently biases said transmission plate to move rearwardly, a lever member that is pivotally connected to said transmission plate, a lever resilient member that resiliently pushes said lever member, and a holding member that is pivotally connected to said outer casing, said lever member having a front arm portion that extends forwardly and that is for being pushed by said push seat, and a rear arm portion that extends rearwardly, said lever resilient member resiliently pushing said rear arm portion upwardly, said holding member having a hook portion;

wherein, said door lock is operable to switch between an open state and a lock state, when said door lock is in said open state, said latch member and said auxiliary latch member projecting out of said outer casing, and said bolt member being retained in said outer casing by said hook portion of said holding member, when said door lock is in said lock state, said bolt member and said latch member projecting out of said outer casing, and said auxiliary latch member abutting against the door frame and being substantially retracted in to said outer casing;

wherein, during switch of said door lock from the open state to the lock state along with the closing operation of the door leaf, said latch member is pushed by the door frame to retract into said outer casing against the biasing action of said latch resilient member after said latch member comes into contact with the door frame so as to move said limiting portion of said latch connecting member past said rear arm portion of said lever member, and said auxiliary latch member is pushed by the door frame 200 to retract into said outer casing against the biasing action of said auxiliary latch resilient member to separate said push seat from said front arm portion of said lever member, so that said rear arm portion is moved onto the path of movement of said limiting portion of said latch connecting member by said lever resilient member; and wherein, when said latch member is biased by said latch resilient member to project out of said outer casing again to engage the door frame after the door leaf is closed, said limiting portion of said latch connecting member pushes and moves said rear arm portion of said lever member to move said transmission plate forwardly against the biasing action of said plate resilient member, so that said holding member pivots downwardly and said hook portion of said holding member releases said bolt member and said bolt connecting member to thereby permit said bolt member to be biased by said bolt resilient member to project out of said outer casing to engage the door frame.

2. The door lock as claimed in claim 1, wherein said push seat has a push protrusion, said front arm portion of said lever member having an inclined surface that faces said push protrusion of said push seat and that is for being pushed by said push protrusion.

3. The door lock as claimed in claim 1, wherein said auxiliary latch unit further includes a mounting seat that is fixedly connected to said outer casing and that permits said push seat to be slidably disposed thereon, said auxiliary latch resilient member having an end that abuts against said mounting seat, and an opposite end that abuts against said push seat.

4. The door lock as claimed in claim 1, wherein said transmission plate has a top protrusion that is in slidable contact with said holding member, said holding member further having a recess, during the switch of said door lock from the open state to the lock state, said top protrusion of said transmission plate being moved along with the forward movement of said transmission plate to correspond in position to said recess of said holding member, so that said holding member pivots downwardly to engage said recess with said top protrusion and that said hook portion releases said bolt member and said bolt connecting member.

5. The door lock as claimed in claim 1, further comprising a lock core unit disposed in said outer casing, and including lock core that permits a key to be inserted therein and that is rotated by the key, a push member that is co-rotatably mounted to said lock core, a bolt push arm that is pivotally connected to said outer casing and that is for pushing said bolt connecting member, and a latch push arm that is pivotally connected to said outer casing and that is for pushing said latch connecting member, said latch push arm tending to be uprightly-disposed and having an upper arm portion and a lower arm portion, said lever member further having an extending arm portion that extends upwardly from said rear arm portion, said bolt connecting member further having a support protrusion at a rear end thereof for supporting said lower arm portion of said latch push arm, rotation of said push member rotating said bolt push arm to move said bolt connecting member rearwardly, so that said support protrusion is separated from said lower arm portion of said latch push arm to permit said lower arm portion to move to abut against said limiting portion of said latch connecting member and to permit said upper arm portion to move to the path of movement of said push member, and that said bolt connecting member pushes said extending arm portion to remove said rear arm portion from the path of movement of said latch connecting member to permit said transmission plate to be moved rearwardly by said plate resilient member, the rearward movement of said transmission plate driving said holding member to pivot upwardly, so as to retain said bolt member and said bolt connecting member within said outer casing by said hook portion thereof, further rotation of said push member rotating said latch push arm to move said latch connecting member rearwardly, so as to retract said latch member into said outer casing.

6. The door lock as claimed in claim 5, wherein said bolt connecting member further has a push surface that faces rearwardly for pushing said extending arm portion of said lever member.

7. The door lock as claimed in claim 5, wherein said latch push arm has a center of gravity at said lower arm portion.

8. The door lock as claimed in claim 1, further comprising an electric lock unit, and a handle unit that is coupled to said electric lock unit for manual operation, said electric lock unit including a push arm that is pivotally connected to said outer casing for pushing said bolt connecting member and said latch connecting member to move rearwardly, and a driving module that is operable to associate said handle unit with said push arm.

9. The door lock as claimed in claim 8, wherein said push arm has a pivot portion that is pivotally connected to said outer casing, a first push portion that is opposite to said pivot portion and that is for pushing said bolt connecting member, and a second push portion that is located between said pivot portion and said first push portion and that is for pushing said limiting portion of said latch connecting member, said bolt connecting member having a protruding block at a rear end thereof for being pushed by said push arm.

10. The door lock as claimed in claim 8, further comprising a control unit that is electrically coupled to said driving module to control said driving module and that is adapted to be signally coupled to a portable device.

* * * * *